US006213110B1

(12) United States Patent
Christopher et al.

(10) Patent No.: US 6,213,110 B1
(45) Date of Patent: Apr. 10, 2001

(54) RAPID FEED PAINTBALL LOADER

(75) Inventors: James T. Christopher; Albert G. Schilling, both of Garland, TX (US)

(73) Assignee: Odyssey Paintball Products, Inc., Garland, TX (US)

( * ) Notice: Subject to any disclaimer, the term of this patent is extended or adjusted under 35 U.S.C. 154(b) by 0 days.

(21) Appl. No.: 09/465,440

(22) Filed: Dec. 16, 1999

(51) Int. Cl.[7] ..... F41B 11/02
(52) U.S. Cl. ..... 124/51.1; 124/48
(58) Field of Search ..... 124/48, 49, 51.1; 221/258, 277

(56) References Cited

U.S. PATENT DOCUMENTS

| | | | | |
|---|---|---|---|---|
| 1,743,576 | * | 1/1930 | Smith . | |
| 3,610,223 | * | 10/1971 | Green . | |
| 4,027,646 | * | 6/1977 | Sweeton | 124/48 X |
| 4,207,857 | * | 6/1980 | Balka . | |
| 5,097,985 | * | 3/1992 | Jones | 124/48 X |
| 5,282,454 | | 2/1994 | Bell et al. | 124/49 |
| 5,722,383 | * | 3/1998 | Tippmann et al. | 124/48 X |
| 5,736,720 | | 4/1998 | Bell et al. . | |
| 5,794,606 | | 8/1998 | Deak | 124/51.1 |
| 5,816,232 | | 10/1998 | Bell | 124/51.1 |
| 5,954,042 | | 9/1999 | Harvey | 124/51.1 |

* cited by examiner

*Primary Examiner*—John A. Ricci
(74) *Attorney, Agent, or Firm*—Smith, Danamraj, & Youst

(57) ABSTRACT

A rapid feed paintball loader for use upon a conventional paintball gun. The rapid feed paintball loader includes a container for holding a plurality of paintballs. At a bottom portion of the container is a rotatable drive cone having a plurality of vertical fins. Each fin spirals outwardly from a center axis of the drive cone. In addition, each fin forms a gap with an adjacent fin large enough to accommodate a paintball. At the bottom of the container is an exit tube which exits from the bottom portion of the container and leads to an inlet tube of the paintball gun. A portion of the exit tube is sloped at an angle equivalent to the slope of a top surface of the drive cone. A catch arm is mounted on an interior surface of the container adjacent to the sloped exit portion of the exit tube. The catch arm is mounted at a height which is above the top surface of the fins, and which is approximately equal to the radius of a paintball. During the operation of the paintball loader, a plurality of paintballs are placed in the interior space of the container. The paintballs fall into the gaps of the drive cone. The rotating drive cone pushes the paintballs toward the first opening. The catch arm then forces the paintball located in the gap into the exit tube for delivery to the paintball gun.

22 Claims, 5 Drawing Sheets

RAPID FEED PAINTBALL LOADER

BACKGROUND OF THE INVENTION

1. Technical Field of the Invention

This invention relates to paintball loaders, and more particularly, to a paintball loader which forcibly and rapidly feeds paintballs to a paintball gun.

2. Description of Related Art

The use of paintball guns has increased over the past few years. One very popular game utilizing these paintball guns is a war game having two teams of players trying to capture one another's flag. The war game is played on a large field with opposing home bases at each end. Each team's flag is located at the player's home base. In addition, all of the players have a paintball gun that shoots paintballs. These paintballs are gelatin-covered spherical capsules filled with paint. During play of the game, the players on each team advance towards the opposing team's base in hopes of stealing the opposing team's flag, without being eliminated from the war game. A player is eliminated from the game when the player is hit by a paintball fired from an opposing player's gun. When the paintball hits a player, a "splat" of paint is left on the player.

The war games have grown in popularity and sophistication, requiring the use of more elaborate equipment. One such improvement is seen in the use of semi-automatic and automatic paintball guns, allowing the rapid dispersal of paintballs. Since these automatic guns shoot paintballs at a rapid rate, paintball loaders are required to store a large number of paintballs and rapidly feed the paintballs into the paintball guns. However, existing paintball loaders are unable to reliably feed paintballs to the paintball guns at the rapid rate demanded by the guns.

Typically, an existing paintball loader includes a housing which is placed on an upper portion of a paintball gun. The housing is shaped to hold a large quantity of paintballs. At the bottom of the housing is an outlet tube through which the paintballs drop by the force of gravity. The outlet tube leads to an inlet tube located on the upper portion of the gun.

During the operation of existing paintball loaders, paintballs sequentially drop by gravity through the outlet tube into the inlet tube of the gun. The inlet tube directs each paintball into the firing chamber of the gun, where the paintball is propelled outwardly from the gun by compressed air. However, the existing paintball loaders function properly to feed the paintballs into the gun only if the gun and loader are held in an approximately vertical (upright) position. This is because the paintballs fall from the loader into the outlet tube, by the force of gravity. If, during the course of a game, the player holds the gun sideways or upside down, the loader will not function properly.

Additionally, during the operation of delivering the paintballs to the gun, jams occasionally occur in the loaders. The jams result in the failure to supply paintballs to the gun, requiring the player to take corrective action by, for example, shaking the gun to clear the jam, or striking the loader to dislodge the jammed paintball. Of course, jams are not desirable since players must divert their attention from firing paintballs to clearing the jammed loader. Therefore, to increase the performance of a paintball gun, a paintball loader is needed which reliably and forcibly delivers paintballs to a paintball gun at a rapid rate, while preventing or automatically removing paintball jams.

Although there are no known prior art teachings of a solution to the aforementioned deficiency and shortcoming such as that disclosed herein, prior art references that discuss subject matter that bears some relation to matters discussed herein are U.S. Pat. No. 5,282,454 to Bell et al. (Bell '454) and U.S. Pat. No. 5,816,232 to Bell (Bell '232).

Bell '454 discloses a bulk loader for a semi-automatic paintball gun which includes a storage housing positioned on a paintball gun. The housing includes a bottom outlet opening and a feed tube located at the bottom outlet opening and connected to an outer end of an in-feed elbow on the gun. During operation of the loader, a series of paintballs fall into the feed tube and are vertically stacked for sequential delivery to the gun through an inner end of the in-feed elbow. If a paintball jam occurs within the storage housing, a void is created at a top end of the feed tube above the downwardly moving paintball stack. An optical sensor detects the void and actuates a motor driven agitator member within the housing, adjacent to its bottom outlet opening. The agitator member engages and shifts the jammed paintballs to permit additional paintballs to fall through the housing outlet opening into the feed tube. When the jam is cleared, the sensor detects the filling of the tube void and turns the agitator member off. Although Bell '454 provides some protection against jams, Bell '454 suffers from the disadvantage of not effectively removing all jams. Additionally, Bell '454 merely discloses a gravity-feed loader, which does not allow paintballs to be forcibly delivered to a gun at high rates, which is needed for semi-automatic and automatic paintball guns. The optical sensor disclosed in Bell '454 is also not reliable when subjected to the harsh treatment normally seen in paintball wars.

Bell '232 also discloses a feed loader for a paintball gun. The feed loader includes a rotatable paddle positioned in an interior space which pushes paintballs out of a housing of the loader and through an interior passageway. The paintballs are pushed into the interior passageway and drop into a vertical out-feed tube where the paintballs form a paintball stack. During the firing of the paintball gun, the paintball stack is depleted until a sensor detects the absence of a paintball at a specified location within the out-feed tube. Upon detecting the absence, the sensor activates a motor which rotates the paddle pushing the paintballs through the interior passageway and into the out-feed tube, where they replenish the paintball stack. When the stack is fully replenished, the sensor detects the presence of a paintball at the specified location and deactivates the motor, which stops the paddle. However, Bell '232 does not teach or suggest actively and forcibly feeding the paintballs into the paintball gun. Bell '232 merely discloses utilizing a paddle to push the paintballs toward an opening leading to the out-feed tube. The paintballs still drop, by the force of gravity to the paintball stack. Bell '232 suffers from the disadvantage of utilizing gravity to provide the force to deliver the paintballs to the paintball gun. Bell '232 does not teach or suggest a device to actively force the paintballs through the out-feed tube.

Review of each of the foregoing references reveals no disclosure or suggestion of an apparatus as that described and claimed herein. Thus, it would be a distinct advantage to have an apparatus which forces the paintballs at a rapid rate into the paintball gun, while simultaneously and automatically removing jams during the operation of the paintball gun. It is an object of the present invention to provide such an apparatus.

SUMMARY OF THE INVENTION

In one aspect, the present invention is a rapid feed paintball loader for use on a paintball gun. The paintball loader includes a container for holding a plurality of paintballs and a drive cone rotatably mounted on a bottom portion of the container. The drive cone has a top surface that slopes downward from a center axis of the drive cone. In addition, the paintball loader includes an exit tube which exits from the bottom portion of the container and leads to an inlet tube of the paintball gun. The exit tube has a sloped exit portion with a slope approximately equivalent to the slope of the top surface of the drive cone. The loader includes a plurality of vertical fins affixed to the top surface of the drive cone. The plurality of fins spiral outwardly from the center axis of the drive cone. Each fin has a top surface and forms a gap with an adjacent fin large enough to accommodate a paintball. The paintball loader also includes a catch arm mounted on an interior surface of the container adjacent to the sloped exit portion of the exit tube. The catch arm is mounted at a height which is above the top surface of the fins and which is approximately equal to the radius of a paintball. The loader also includes a motor that rotates the drive cone and means for actuating the motor on demand.

In another aspect, the present invention is a rapid feed paintball loader for use on a paintball gun. The paintball loader includes a container for holding a plurality of paintballs and a drive cone rotatably mounted on a bottom portion of the container. An exit tube exits from a bottom portion of the container and leads to an inlet tube of the paintball gun. A plurality of fins are affixed to the top surface of the drive cone and spiral outwardly from the center axis of the drive cone. Each fin has a top surface and forms a gap with an adjacent fin large enough to accommodate a paintball. A catch arm is mounted on an interior surface of the container adjacent to the exit tube. The catch arm is mounted at a height which is above the top surface of the fins and which is approximately equal to the radius of a paintball. A motor rotates the drive cone. The paintball loader also includes a means for actuating the motor upon demand.

In still another aspect, the present invention is a rapid feed paintball loader. The paintball loader includes a container for holding a plurality of paintballs and a plurality of fins located at a bottom portion of the container. Each fin has a top surface and forms a gap with an adjacent fin large enough to accommodate a paintball. The paintball loader also includes means for rotating the plurality of fins about an axis running perpendicularly through the bottom portion of the container. In addition, the paintball loader also includes an exit tube exiting from the bottom portion of the container and leading to an inlet tube of the paintball gun. The exit tube has a sloped exit portion. A catch arm is also mounted on an interior surface of the container adjacent to the sloped exit portion of the exit tube. The catch arm is mounted at a height which is above the top surface of the fins and which is approximately equal to the radius of a paintball. A motor rotates the drive cone. The paintball loader also includes means for actuating the motor upon demand.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A paintball loader for rapidly delivering paintballs with positive force to a paintball gun is disclosed.

Figure 1:
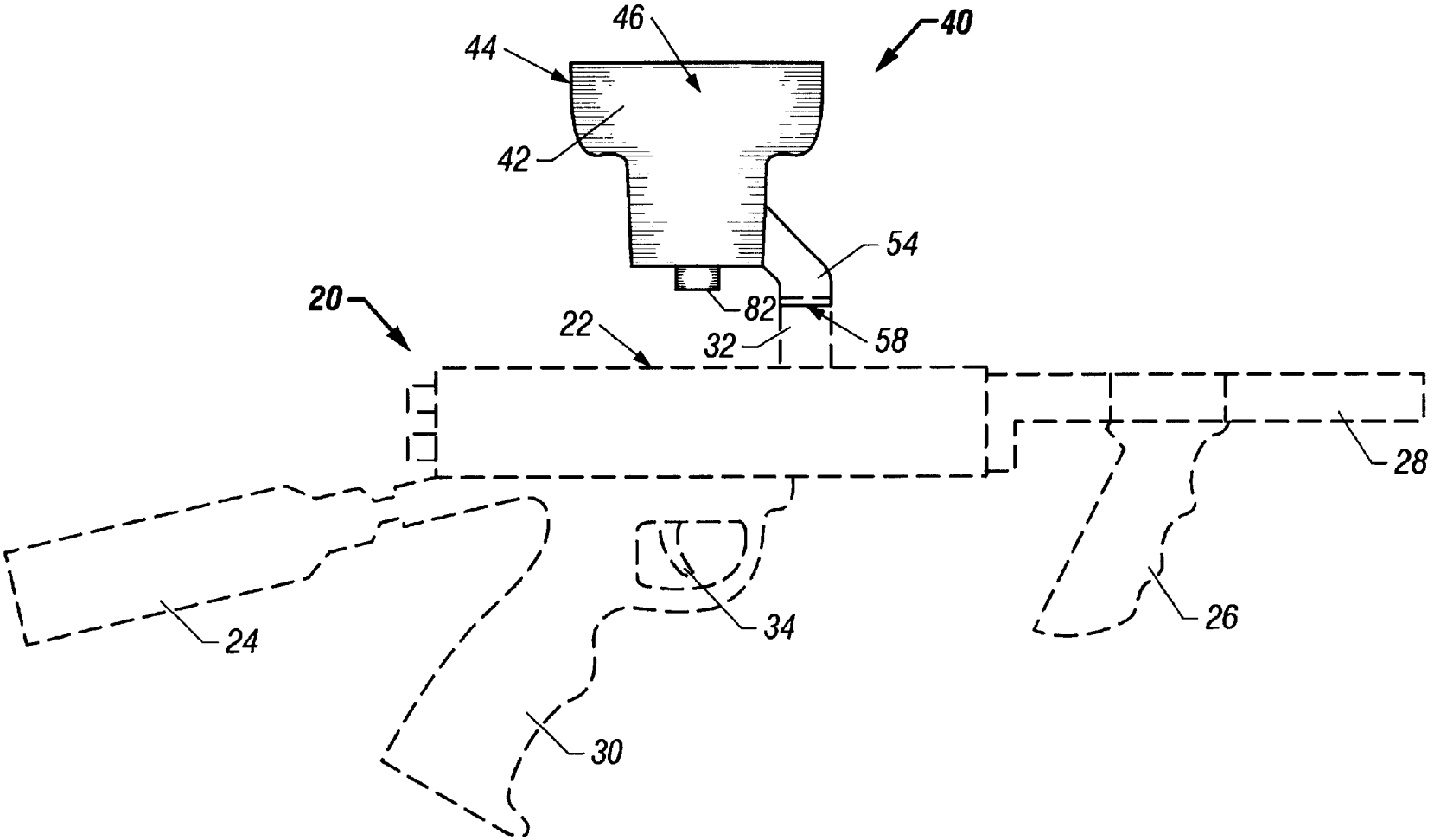
FIG. 1 is a side elevational view of a rapid feed paintball loader constructed in accordance with the teachings of the present invention and operatively attached to a representative paintball gun illustrated in phantom.

FIG. 1 is a side elevational view of a rapid feed paintball loader 40 constructed in accordance with the teachings of the present invention and operatively attached to a representative paintball gun 20 illustrated in phantom. The paintball gun 20 includes a main body 22, a compressed gas cylinder 24, a front handgrip 26, a barrel 28, and a rear handgrip 30. The paintball gun also includes an inlet tube 32 leading to a firing chamber (not shown) in the interior of the main body and a trigger 34. The front handgrip projects downwardly from the barrel and provides an area for gripping by an operator of the paintball gun. The compressed gas cylinder is typically secured to a rear portion of the paintball gun. The compressed gas cylinder normally contains $CO_2$, although any compressible gas may be used.

In operating the paintball gun 20, the trigger 34 is squeezed, thereby actuating the compressed gas cylinder to release bursts of compressed gas. The bursts of gas are used to eject paintballs outwardly through the barrel 28. The paintballs are continually fed by the paintball loader 40 through the inlet tube to the firing chamber. Although FIG. 1 depicts an automatic paintball gun, the paintball gun 20 may also be a semi-automatic gun.

The rapid feed paintball loader 40 includes a paintball container 42 having a container wall 44 forming an interior area 46. An exit tube 54 leads from a bottom portion of the container to an outlet opening 58. The exit tube is positioned on top of the inlet tube 32 of the paintball gun 20.

Figure 2:
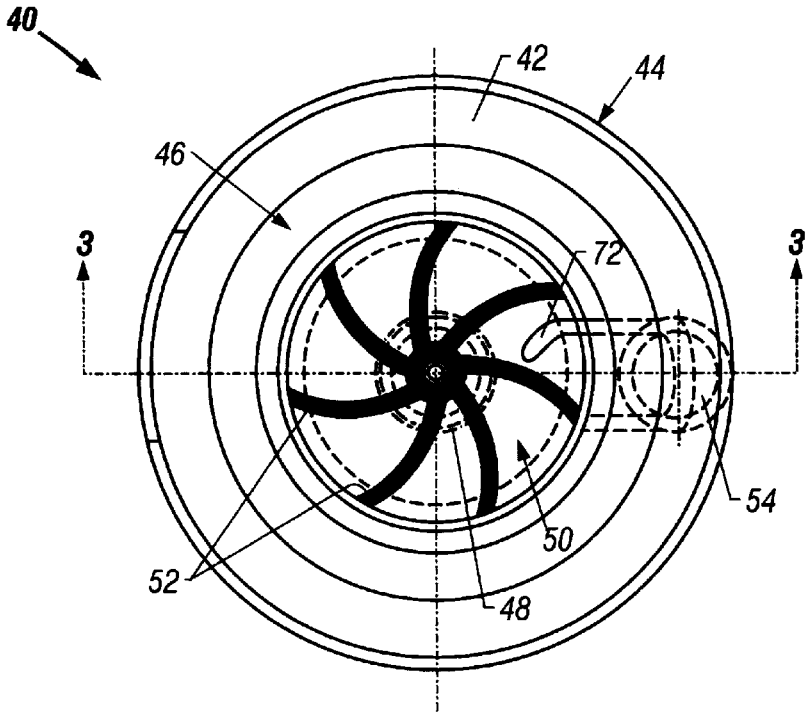
FIG. 2 is a top view of the rapid feed paintball loader of FIG. 1 showing a drive cone.

FIG. 2 is a top view of the rapid feed paintball loader of FIG. 1 showing a drive cone 50. Mounted along a vertical center axis 48, located in the approximate center of the interior area, is the drive cone having a plurality of fins 52 spiraling outwardly from the center axis. The drive cone is rotatably attached to a bottom portion of the paintball container, allowing rotation about the center axis. A paintball catch arm 72 and the exit tube 54 are shown in phantom.

Figure 3:
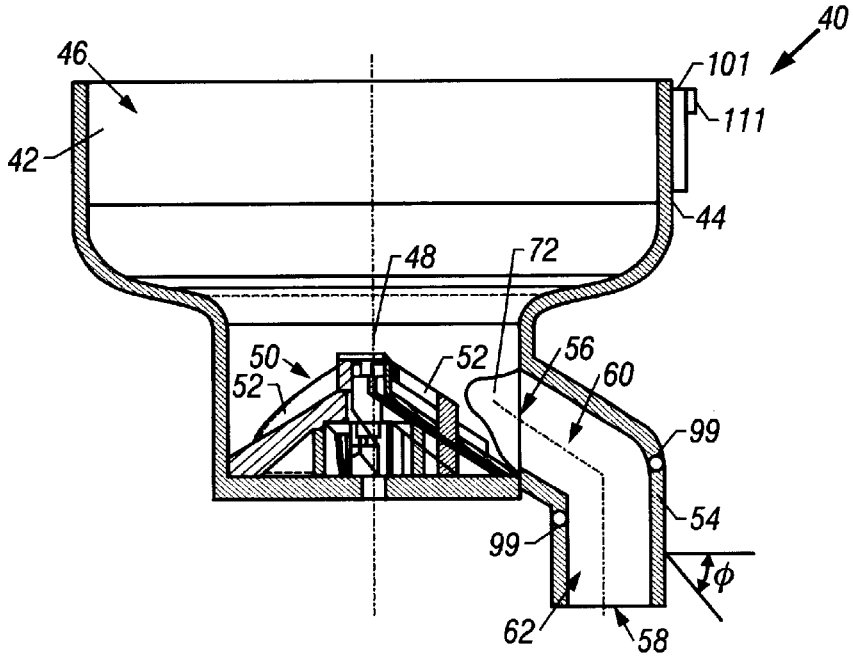
FIG. 3 is a side cross-sectional view of the paintball loader taken along line A—A of FIG. 2 showing the drive cone and an exit tube.

FIG. 3 is a side cross-sectional view of the paintball loader taken along line A—A of FIG. 2 showing the drive cone and an exit tube. In the preferred embodiment of the present invention, the container wall 44 is curved and extends upwards from the drive cone 50. The interior area 46 formed by the container wall stores a plurality of paintballs prior to being used by the paintball gun 20. Although a circular shape is illustrated in the top view of FIG. 2, the container may be any size and shape which permits the paintballs to drop towards the drive cone 50.

The top surface of the drive cone is sloped downwardly at an angle of $\Phi$ (approximately 45 degrees in the preferred embodiment). The surface may slope at any angle which matches the slope of the exit tube and allows paintballs to feed into the exit tube 54. The exit tube is a circular tube with an inside diameter slightly larger than a conventional paintball. The exit tube leads from an entry opening 56 to an exit opening 58 which engages with the inlet tube 32 of the paintball gun. The exit tube includes a sloped exit portion 60 and a vertical outlet portion 62. In the preferred embodiment of the present invention, the sloped exit portion of the exit tube is sloped downwardly at an angle of approximately Φ, which is the same slope as the top surface of the drive cone.

Figure 4:
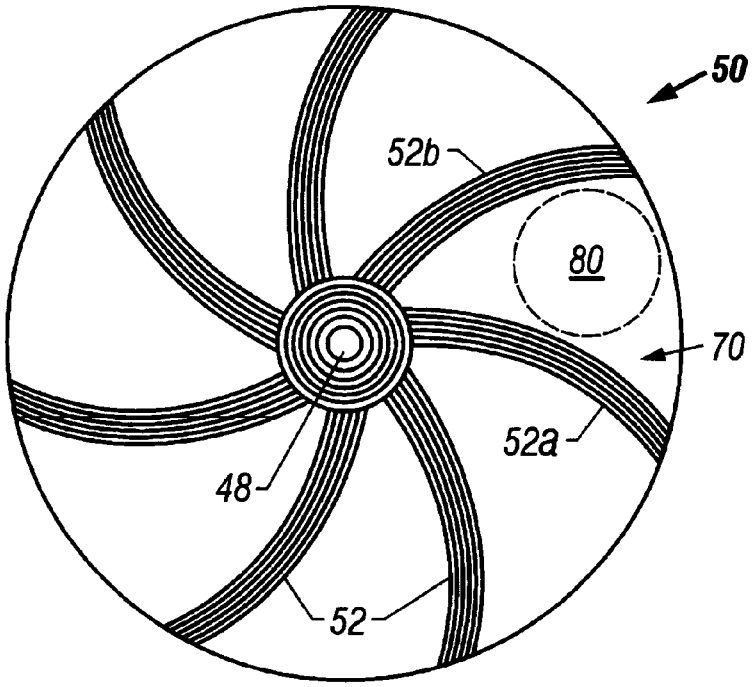
FIG. 4 is a top view of the drive cone of FIG. 2 showing the plurality of fins.

FIG. 4 is a top view of the drive cone of FIG. 2 showing the plurality of fins. As discussed above, the plurality of fins originate at the center axis 48 and spirals outwardly towards the container wall 44 (not shown in FIG. 4). Each fin forms a gap with an adjacent fin which, at the container wall, is sized slightly larger than a conventional paintball. For example, fins 52*a* and 52*b* form a gap 70 to accommodate a conventional paintball 80, shown in phantom. Additionally, each fin curves to the rear as it radiates outward from the center axis so that paintballs are pushed outward as well as forward as the drive cone rotates in the forward direction (counter-clockwise when viewed from above).

Figure 5:
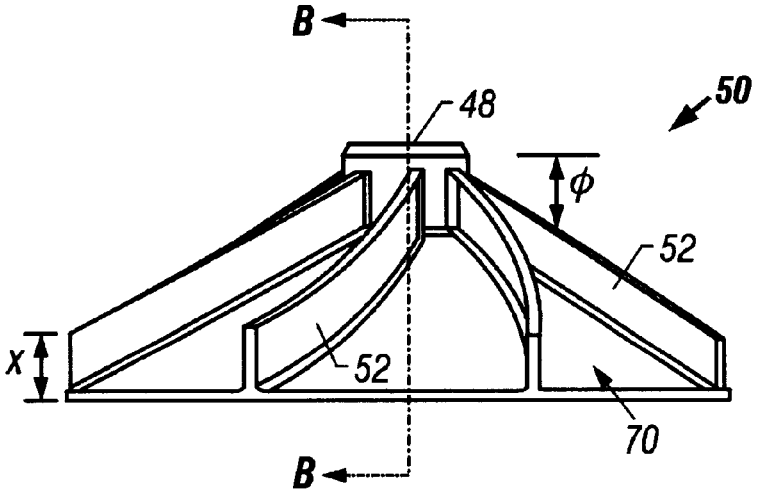
FIG. 5 is a side elevational view of the drive cone of FIG. 4.

FIG. 5 is a side elevational view of the drive cone of FIG. 2. The top surface of the drive cone slopes downward along with the fins 52 at an angle Φ. The fins are integrally mounted to the top surface of the drive cone. In the preferred embodiment, the height X of the fins 52 are slightly less than the radius of a conventional paintball 80.

Figure 6:
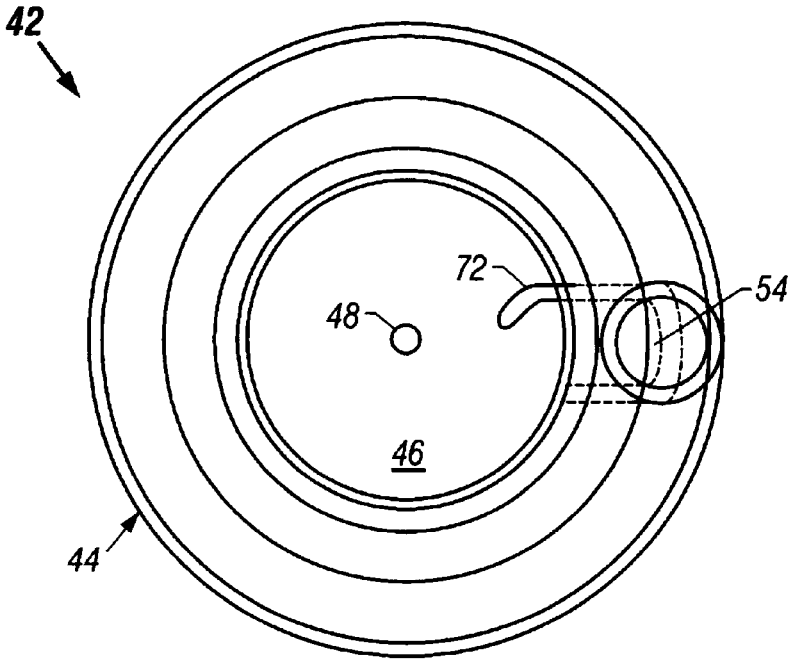
FIG. 6 is a top view of the paintball container without the drive cone.

FIG. 6 is a top view of the paintball container without the drive cone 50. The paintball catch arm 72 and exit tube 54 are shown in phantom.

Figure 7:
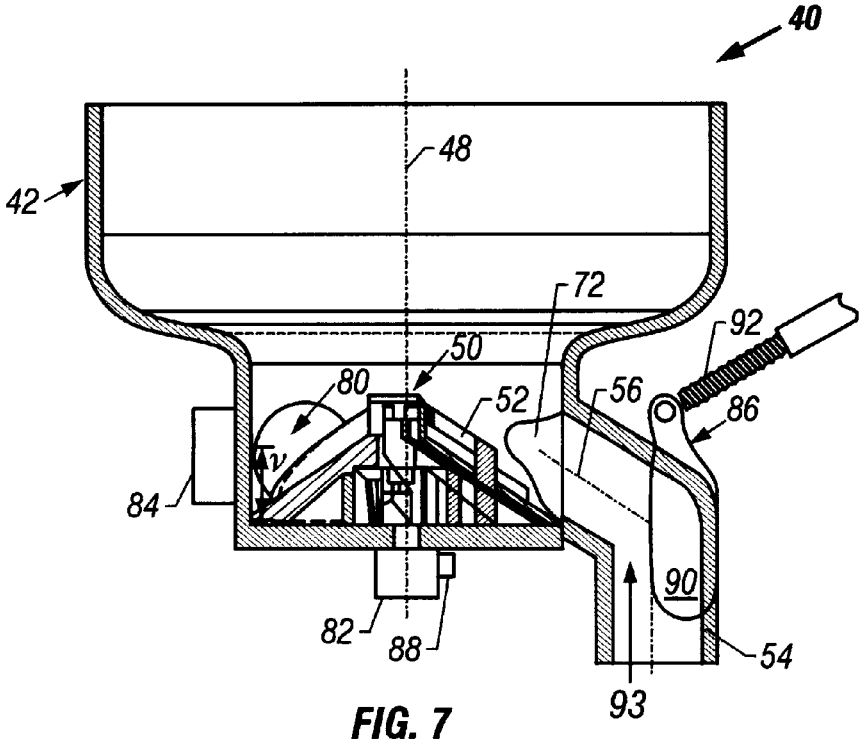
FIG. 7 is a side view of the paintball loader of the present invention illustrating a loaded paintball, drive motor, paintball catch arm, and motor actuator switch.

FIG. 7 is a side view of the paintball loader of the present invention illustrating a loaded paintball 80, motor 82, paintball catch arm 72, and motor actuator switch 86. The catch arm 72 is located at the entry opening 56. The catch arm is an extension of the exit tube 54. The catch arm extends towards the center axis 48, maintaining a clearance above the fins 52. In the preferred embodiment of the present invention, the catch arm is located at a midpoint height Y (FIG. 8), allowing the catch arm to capture the paintball at its approximate midpoint. The paintball catch arm is formed as a scoop which has an interior radius of curvature equal to the curvature of a paintball. The top of the scoop is positioned so that it partially covers a paintball that is pushed into position by the fins at the entry opening 56 of the exit tube. In this manner, the sloped surface of the drive cone, the radially curved fins, and the catch arm all equate to forcibly drive the paintball into the exit tube.

The drive cone 50 is rotated around the center axis 48 by a drive motor 82. The motor 82 may be a conventional dc electric motor powered by a power supply 84, such as a 9-volt battery. The paintball loader 40 also includes an electromechanical motor-actuator switch 86 located in an interior portion of the exit tube 54. The motor-actuator switch includes a rotating actuator arm 90 which detects the presence of paintballs within the exit tube and activates and deactivates the motor through a contact switch 92.

In the preferred embodiment of the present invention, the paintball loader 40 may include a microprocessor 88 to enhance the performance of the loader as well as providing useful information to a paintball gun operator.

Figure 8:
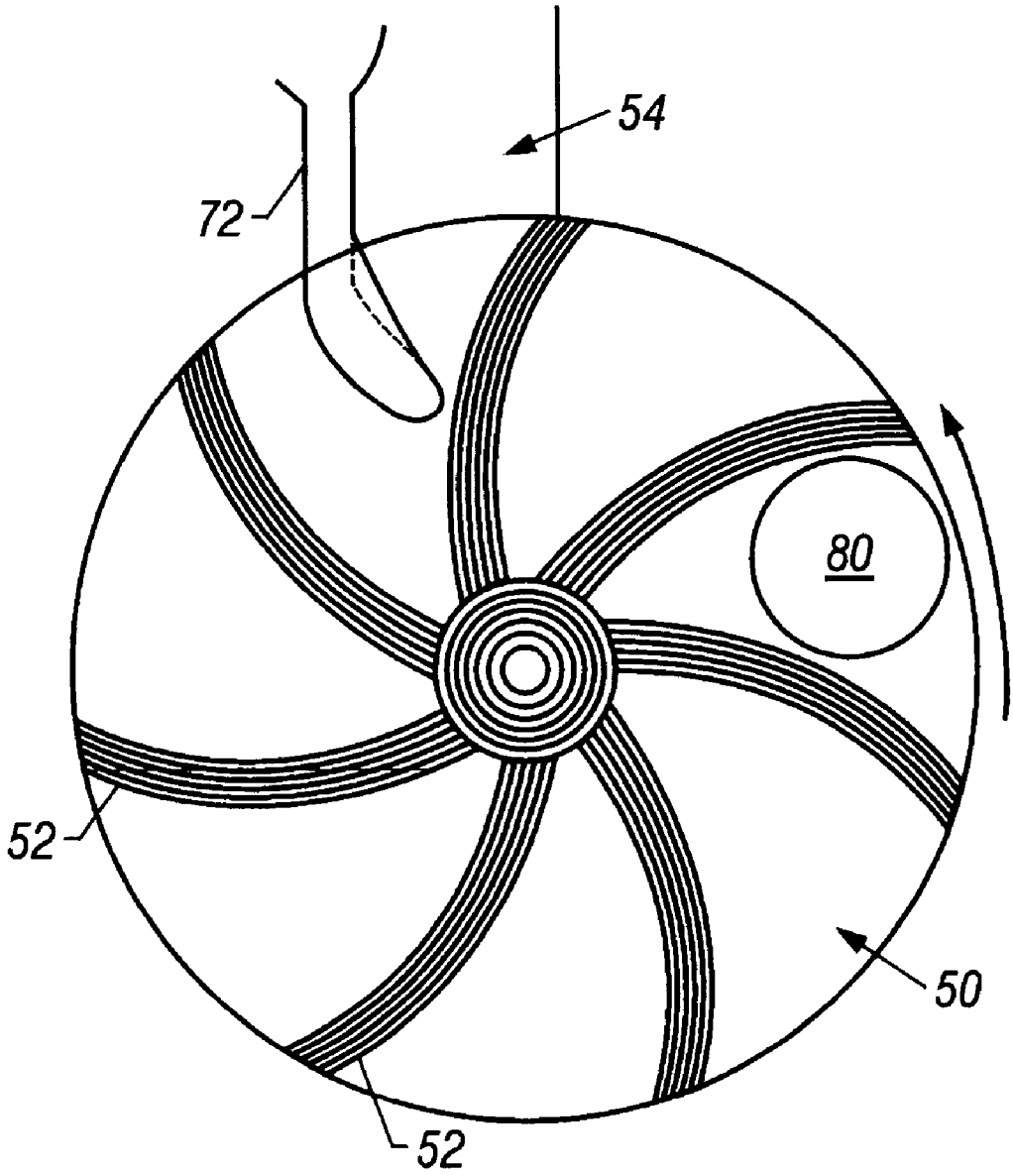
FIG. 8 is a top view of the drive cone, the catch arm, and the exit tube in the preferred embodiment of the present invention.

FIG. 8 is a top view of the drive cone 50, the catch arm 72, and the exit tube 54 in the preferred embodiment of the present invention. The drive cone is preferably rotated counter-clockwise, but may be momentarily rotated clockwise, as described below, to clear a jam. In the preferred embodiment, the catch arm is concavely shaped to accommodate the paintball 80, and guide it into the exit tube.

Referring to FIGS. 1–8, the operation of the rapid feed paintball loader 40 will now be explained. The rapid feed paintball loader is positioned on the top of the paintball gun 20. The loader 40 is connected to the gun by attaching the exit tube 54, at the exit opening 58, to the inlet tube 32 with an attaching device such as a clamp (not shown).

When an operator of the paintball gun 20 wishes to shoot paintballs, the trigger 34 is squeezed, which actuates the compressed gas cylinder 24. The compressed gas cylinder releases bursts of compressed gas which are used to eject paintballs through the barrel 28. A plurality of paintballs are stored in the paintball container 42 and pass down the exit tube for use by the paintball gun when demanded by the operator.

The plurality of paintballs located in the container 42 rest on top of the drive cone 50. The bottom-most paintballs drop into the plurality of gaps 70. The drive cone is rotated by the motor 82, forcing the paintballs outward from the center axis and forward toward the catch arm 72. The paintball 80 is forced into the entry opening of the exit tube 54 by the catch arm. In addition, since the drive cone is downwardly sloped toward the exit tube, the paintball falls, with the assistance of gravity, outwardly. In the preferred embodiment of the present invention, the catch arm grasps the paintball at a middle portion of the paintball. By contacting the paintball at approximately the midpoint height Y of the paintball, the paintball is most effectively driven towards the entry opening 56. After the paintball enters the entry opening, the next paintball located in an adjacent gap 70 is sequentially grasped by the catch arm and driven into the entry opening behind the first paintball. Additionally paintballs located in the container 42, are drawn downwardly and outwardly by gravity and fill the vacated gaps.

Once the paintball 80 enters the entry opening 56, it passes through the sloped exit portion 60 to the vertical outlet portion 62 of the exit tube. The sloped exit portion of the exit tube is sloped at approximately the same angle as the drive cone 50, allowing the paintball to enter the exit tube more easily. As the paintball passes through the exit tube, the paintball actuates the electromechanical motor actuator switch 86. The motor actuator switch detects the paintball passing through the exit tube when the paintball pushes upwardly on the actuating arm 90, which is connected to the spring-loaded contact switch 92. The contact switch turns off the motor 82 when the motor actuator switch detects the paintball in the exit tube. Thus, when the exit tube fills up with paintballs, the motor is automatically turned off. Then as paintballs vacate the exit tube, the actuating arm springs back to its original position, which allows the contact switch to engage the motor and rotate the drive cone 50. In this way, the exit tube is always kept full of paintballs, ready for use when demanded by the paintball gun.

In the preferred embodiment of the present invention, the actuating arm is located at an elbow 93 where the exit tube 54 bends from the sloped exit portion 60 to the vertical outlet portion 62. Ideally, the actuating arm springs downwardly as the paintball passes, thereby providing additionally force to push the paintball downward through the bottom exit opening 58 of the exit tube. The paintball then drops through the vertical outlet portion 62 of the exit tube 54 and exits the bottom of the paintball loader 40 through the exit opening 58. The paintball enters through the inlet tube 32 of the paintball gun 20 and into the firing chamber of the gun. Although an electromechanical switch has been described to detect the presence of paintballs in the exit tube, it should be understood that other devices may also be utilized to detect the paintballs (e.g., infrared senors, contact pads, optical sensors, etc.), without departing from the scope of the present invention. For example, sensors 99 (FIG. 3) may be utilized to detect the paintballs. These sensors may be infrared or optical sensors.

The motor actuator switch is also used to actuate the motor to clear jams within the paintball loader. If paintballs jam within the paintball loader, the drive motor experiences additional resistance in rotating the drive cone. This produces increased torque on the motor and a rise in electrical current. This rise is detected by a motor controller which may be, for example, the microprocessor 88. The motor controller temporarily reverses the direction of the drive motor and drive cone, and then reactivates the motor in the forward direction in order to clear the jam. The curvature of the fins tends to push the paintballs upward and inward toward the top of the cone when the cone is rotated in reverse. In addition, the height of the fins is slightly less than the midpoint height Y of the paintballs, which causes the paintballs to move upwardly away from the surface of the drive cone when any jam occurs on the drive cone.

In the preferred embodiment, the microprocessor 88 also deactivates the drive motor when the exit tube is full. The microprocessor is attached to the motor actuator switch 86 and the motor 82. When the motor actuator switch detects the presence of a paintball at the top of the exit tube, the motor actuator switch sends a signal to the microprocessor. In turn, the microprocessor sends a signal to disengage the motor. When the motor actuator switch does not detect any paintballs within the exit tube, the motor actuator switch signals the microprocessor that the exit tube is empty. The microprocessor can then signal the motor to engage and rotate the drive cone, providing additional paintballs to the paintball gun.

The microprocessor may also be used in conjunction with a display 101 (FIG. 3) such as an LED or LCD display to present relevant data to the operator of the paintball gun 20. The microprocessor may be used to count the amount of shots fired or shots per second fired by the paintball gun by receiving data from the motor actuator switch (e.g., the number of paintballs passing through the exit tube detected by the motor actuator switch). Additionally, the microprocessor may be connected to the power supply 84, displaying the power remaining in the power supply. For example, the microprocessor may monitor the remaining life of a battery, if a battery is used as the power supply. The microprocessor can then present this data to the operator through the display 101, which may be affixed on top of the rapid feed paintball loader, for easy viewing by the operator.

A timer 111 may also be incorporated into the paintball loader 40. The timer may provide the running time of the game as well as an audio, visual, or vibratory warning to the operator when a predetermined amount of time remains in the game. The timer may be a separate display located on the paintball loader or may be controlled by the microprocessor 88.

The paintball loader 40 provides many advantages over existing paintball loaders. Unlike existing paintball loaders, the paintball loader 40 forcibly feeds the paintballs into the exit tube leading to the paintball gun. The curving shape of the fins 52 and the curved catch arm drive the paintballs into the exit tube. Thus, the paintball loader of the present invention is more effective at loading paintballs when the orientation of the gun is not vertical. In addition, since the slope of the drive cone and the slope of the sloped exit portion 60 of the exit tube are substantially the same, the ball enters the exit tube with a greater force than existing paintball loaders.

The greater force applied to the paintball while entering into the exit tube provides two important advantages. First, the added force of the paintball allows the use of an electromechanical switch. In existing systems, the force of the paintball entering the exit tube is not great enough to actuate an electromechanical switch. Therefore, existing systems are forced to use an infrared (IR) sensor to detect the presence of paintballs within the exit tube. However, IR sensors are not very reliable and, in many instances, are unable to endure the harsh treatment commonly seen in the use of the paintball guns. On the other hand, an electromechanical switch is much more reliable and able to withstand the harsher treatment. The second advantage of applying greater force to the paintball is that the paintballs can be delivered to the paintball gun at a greater rate, thereby significantly increasing the potential firing rate of the paintball gun.

The rapid feed paintball loader 40 also provides relevant information through the use of the microprocessor to the operator. In addition, the microprocessor can automatically remove jams by momentarily reversing the direction of rotation of the drive cone. Thus, the paintball loader is a more reliable system and provides paintballs to the paintball gun at a greater rate, automatically removes jams, and presents important data to the user.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A rapid feed paintball loader for use on a paintball gun, the paintball loader comprising:

a container for holding a plurality of paintballs;

a drive cone rotatably mounted on a bottom portion of the container, said drive cone having a top surface that slopes downward from a center axis of said drive cone;

an exit tube exiting from the bottom portion of the container and leading to an inlet tube of the paintball gun, said exit tube having a sloped exit portion;

a plurality of fins affixed to the top surface of the drive cone, each fin having a top surface and forming a gap with an adjacent fin large enough to accommodate a paintball;

a catch arm mounted on an interior surface of the container adjacent to the sloped exit portion of the exit tube, said catch arm being mounted at a height which is above the top surface of the fins and which is approximately equal to the radius of a paintball;

a motor that rotates the drive cone; and means for actuating the motor upon demand.

2. The rapid feed paintball loader of claim 1, wherein the motor is an electric motor powered by a power supply.

3. The rapid feed paintball loader of claim 2, wherein the power supply is a battery.

4. The rapid feed paintball loader of claim 1, the means for actuating the motor upon demand includes a detector for detecting a presence of paintballs at a selected position within the exit tube.

5. The rapid feed paintball loader of claim 4, wherein said detector is an electromechanical switch located within the exit tube.

6. The rapid feed paintball loader of claim 5, wherein the electro-mechanical switch includes an actuating arm located in the exit tube and a contact switch connected to the motor, whereby each paintball entering the exit tube actuates the actuating arm which forces the contact switch to disengage the motor.

7. The rapid feed paintball loader of claim 4, wherein said detector is an infrared sensor.

8. The rapid feed paintball loader of claim 4, wherein said detector is an optical sensor.

9. The rapid feed paintball loader of claim 4, further comprising a microprocessor communicating with the detector and the motor.

10. The rapid feed paintball loader of claim 9, further comprising a display positioned on the container and wherein said microprocessor displays relevant data to an operator of the paintball gun on the display.

11. The rapid feed paintball loader of claim 10 wherein the display includes a timer.

12. The rapid feed paintball loader of claim 11 wherein said timer emits an audio warning after a preselected time has elapsed.

13. The rapid feed paintball loader of claim 11 wherein said timer displays a visual warning after a preselected time has elapsed.

14. The rapid feed paintball loader of claim 11 wherein said timer provides a vibratory alert after a preselected time has elapsed.

15. The rapid feed paintball loader of claim 4, wherein said means for actuating the motor upon demand includes a microprocessor which disengages the motor when receiving a signal from the detector that the presence of paintballs is detected in the exit tube.

16. The rapid feed paintball loader of claim 15 wherein said microprocessor momentarily reverses a rotational direction of the motor when said microprocessor detects a specified increase in torque output from the motor.

17. The rapid feed paintball loader of claim 1 wherein each fin has a height less than the radius of a paintball.

18. The rapid feed paintball loader of claim 1 wherein the sloped exit portion has a slope approximately equivalent to the slope of the top surface of the drive cone.

19. The rapid feed paintball loader of claim 1 wherein the fins are vertical.

20. The rapid feed paintball loader of claim 1 wherein the plurality of fins spiral outwardly from the center axis of the drive cone and rearwardly from the direction of rotation of the drive cone.

21. A rapid feed paintball loader for use on a paintball gun, the paintball loader comprising:

a container for holding a plurality of paintballs;

a drive cone rotatably mounted on a bottom portion of the container;

an exit tube exiting from a bottom portion of the container and leading to an inlet tube of the paintball gun;

a plurality of fins affixed to the top surface of the drive cone, said plurality of fins spiraling outwardly from the center axis of the drive cone, each fin having a top surface and forming a gap with an adjacent fin large enough to accommodate a paintball;

a catch arm mounted on an interior surface of the container adjacent to the exit tube, said catch arm being mounted at a height which is above the top surface of the fins and which is approximately equal to the radius of a paintball;

a motor that rotates the drive cone; and means for actuating the motor upon demand.

22. A rapid feed paintball loader for use on a paintball gun, the paintball loader comprising:

a container for holding a plurality of paintballs;

a plurality of fins located at a bottom portion of the container, each fin having a top surface and forming a gap with an adjacent fin large enough to accommodate a paintball;

means for rotating the plurality of fins about an axis running perpendicularly through the bottom portion of the container;

an exit tube exiting from the bottom portion of the container and leading to an inlet tube of the paintball gun, said exit tube having a sloped exit portion; and a catch arm mounted on an interior surface of the container adjacent to the sloped exit portion of the exit tube, said catch arm being mounted at a height which is above the top surface of the fins and which is approximately equal to the radius of a paintball.

* * * * *

US006213110C1

(12) EX PARTE REEXAMINATION CERTIFICATE (8678th)

United States Patent
Christopher et al.

(10) Number: US 6,213,110 C1
(45) Certificate Issued: Nov. 22, 2011

(54) RAPID FEED PAINTBALL LOADER

(75) Inventors: James T. Christopher, Garland, TX (US); Albert G. Schilling, Garland, TX (US)

(73) Assignee: Kee Action Sports I LLC, Sewell, NJ (US)

Reexamination Request:
No. 90/009,794, Jul. 30, 2010

Reexamination Certificate for:

| | |
|---|---|
| Patent No.: | **6,213,110** |
| Issued: | **Apr. 10, 2001** |
| Appl. No.: | **09/465,440** |
| Filed: | **Dec. 16, 1999** |

(51) Int. Cl.
*F41B 11/02* (2006.01)

(52) U.S. Cl. ..... 124/51.1; 124/48
(58) Field of Classification Search ..... None
See application file for complete search history.

(56) References Cited

To view the complete listing of prior art documents cited during the proceeding for Reexamination Control Number 90/009,794, please refer to the USPTO's public Patent Application Information Retrieval (PAIR) system under the Display References tab.

*Primary Examiner*—Jeffrey R. Jastrzab

(57) ABSTRACT

A rapid feed paintball for use upon a conventional paintball gun. The rapid feed paintball loader includes a container for holding a plurality of paintballs. At a bottom portion of the container is a rotatable drive cone having a plurality of vertical fins. Each fin spirals outwardly from a center axis of the drive cone. In addition, each fin forms a gap with an adjacent fin large enough to accommodate a paintball. At the bottom of the container is an exit tube which exits from the bottom portion of the container and leads to an inlet tube of the paintball gun. A portion of the exit tube is sloped at an angle equivalent to the slope of a top surface of the drive cone. A catch arm is mounted on an interior surface of the container adjacent to the sloped exit portion of the exit tube. The catch arm is mounted at a height which is above the top surface of the fins, and which is approximately equal to the radius of a paintball. During the operation of the paintball loader, a plurality of paintballs are placed in the interior space of the container. The paintballs fall into the gaps of the drive cone. The rotating drive cone pushes the paintballs toward the first opening. The catch arm then forces the paintball located in the gap into the exit tube for delivery to the paintball gun.

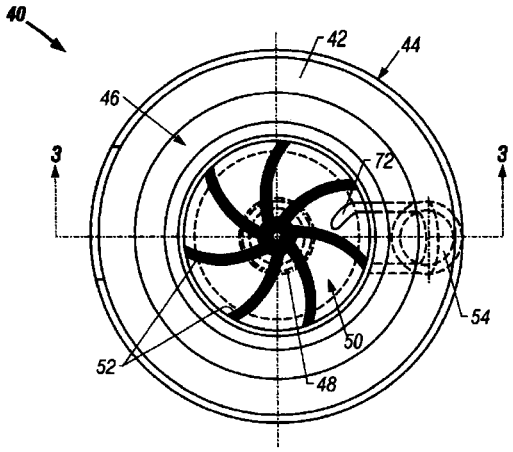

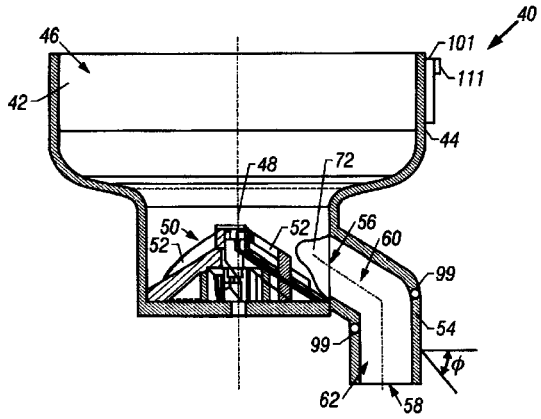

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 21 and 22 are determined to be patentable as amended.

Claims 2-20, dependent on an amended claim, are determined to be patentable.

New claims 23-33 are added and determined to be patentable.

1. A rapid feed paintball loader for use on a paintball gun, the paintball loader comprising:

a container for holding a plurality of paintballs;

a drive cone rotatably mounted on a bottom portion of the container, said drive cone having a *generally frusto-conical* top surface that slopes downward from a center axis of said drive cone;

an exit tube exiting from the bottom portion of the container and [leading] *adapted to lead* to an inlet tube of [the] *a* paintball gun, said exit tube having a sloped exit portion;

a plurality of fins [affixed to] *integrally formed on* the *generally frusto-conical* top surface of the drive cone, each fin having a top surface and forming a gap with an adjacent fin large enough to accommodate a paintball;

a catch arm mounted on an interior surface of the container adjacent to the sloped exit portion of the exit tube, said catch arm being mounted at a height which is above the top surface of the fins and which is approximately equal to the radius of a paintball;

a motor that rotates the drive cone; and means for actuating the motor upon demand.

21. A rapid feed paintball loader for use on a paintball gun, the paintball loader comprising:

a container for holding a plurality of paintballs;

a drive cone rotatably mounted on a bottom portion of the container, *said drive cone having a generally frusto-conical top surface*;

an exit tube exiting from a bottom portion of the container and [leading] *adapted to lead* to an inlet tube of [the] *a* paintball gun;

a plurality of fins [affixed to] *integrally formed on* the *generally frusto-conical* top surface of the drive cone, said plurality of fins spiraling outwardly from the center axis of the drive cone, each fin having a top surface and forming a gap with an adjacent fin large enough to accommodate a paintball;

a catch arm mounted on an interior surface of the container adjacent to the exit tube, said catch arm being mounted at a height which is above the top surface of the fins and which is approximately equal to the radius of a paintball;

a motor that rotates the drive cone; and means for actuating the motor upon demand.

22. A rapid feed paintball loader for use on a paintball gun, the paintball loader comprising:

a container for holding a plurality of paintballs;

*a drive cone rotatably mounted on a bottom portion of the container, said drive cone having a generally frusto-conical top surface;* a plurality of fins located at a bottom portion of the container *integrally formed on the generally frusto-conical top surface of the drive cone*, each fin having a top surface and forming a gap with an adjacent fin large enough to accommodate a paintball;

means for rotating the plurality of fins about an axis running perpendicularly through the bottom portion of the container;

an exit tube exiting from the bottom portion of the container and [leading] *adapted to lead* to an inlet tube of [the] *a* paintball gun, said exit tube having a sloped exit portion; and a catch arm mounted on an interior surface of the container adjacent to the sloped exit portion of the exit tube, said catch arm being mounted at a height which is above the top surface of the fins and which is approximately equal to the radius of a paintball.

*23. A rapid feed paintball loader for use on a paintball gun, the paintball loader comprising:*

*a container for holding a plurality of paintballs;*

*an exit tube exiting from the bottom portion of the container and adapted to lead to an inlet tube of a paintball gun, said exit tube having a sloped exit portion;*

*a drive cone having an overall conical shape rotatably mounted on a bottom portion of the container, the drive cone having a plurality of fins, the drive cone having a generally frusto-conical top surface located between the fins that slopes downwardly from a center axis of said drive cone, the drive cone rotated by a motor;*

*the generally frusto-conical top surface of the drive cone configured to receive paintballs in the container such that paintballs rest on a portion of the generally frusto-conical top surface for feeding;*

*the plurality of fins integrally formed on the generally frusto-conical top surface of the drive cone, each of the fins having a top surface, each of the fins forming a gap on the generally frusto-conical top surface of the drive cone with an adjacent one of the fins large enough to accommodate a paintball, wherein rotation of the drive cone forces a paintball positioned in the gap toward the sloped exit portion;*

*a catch arm mounted on an interior surface of the container adjacent to the sloped exit portion of the exit tube, said catch arm being mounted at a height which is above the top surface of the fins and which is approximately equal to the radius of a paintball, wherein the catch arm has an interior surface which is defined by a radius that is approximately equal to the radius of a paintball; and*

*a means for actuating the motor upon demand.*

*24. The rapid feed paintball loader of claim 23, wherein the fins have a substantially rectangular cross-section.*

*25. The rapid feed paintball loader of claim 23, further comprising a detector in communication with the motor, the*

*detector positioned to detect a presence of paintballs in the exit tube, the motor rotating the drive cone in response to the detector detecting that paintballs are not present at a selected position within the exit tube.*

*26. The rapid feed paintball loader of claim 23, further comprising a detector in communication with the motor, the detector positioned to detect paintballs at a selected position in the exit tube, wherein the motor is configured to operate until the presence of a paintball is detected by the detector at a selected position within the exit tube.*

*27. The rapid feed paintball loader of claim 23, further comprising a detector in communication with the motor, the detector positioned to detect a presence of paintballs in the exit tube, the motor rotating the drive cone in response to the detector signaling for the demand of paintballs in the exit tube.*

*28. A rapid feed paintball loader for use on a paintball gun, the paintball loader comprising:*

*a container for holding a plurality of paintballs;*

*an exit tube exiting from the bottom portion of the container and adapted to lead to an inlet tube of a paintball gun, said exit tube having a sloped exit portion;*

*a drive cone having an overall conical shape including a plurality of fins integrally formed on a generally frusto-conical top surface of the drive cone rotatably mounted on a bottom portion of the container, each of the fins having a top surface, each of the fins forming a gap with an adjacent one of the fins large enough to accommodate a paintball, the drive cone including a downwardly sloping feed surface at the outermost edge of the drive cone, the feed surface configured to receive paintballs such that paintballs rest on the feed surface;*

*means for rotating the drive cone about an axis running perpendicularly through the bottom portion of the container; and,*

*a catch arm mounted on an interior surface of the container adjacent to the sloped exit portion of the exit tube, said catch arm being mounted at a height which is above the top surface of the fins and which is approximately equal to the radius of a paintball and which is approximately equal to the radius of a paintball, wherein the catch arm has an interior surface which is defined by a radius that is approximately equal to the radius of a paintball.*

*29. The rapid feed paintball loader of claim 28, wherein the fins have a substantially rectangular cross-section.*

*30. The rapid feed paintball loader of claim 28, wherein the downwardly sloping feed surface comprises a generally frusto-conical portion within the gap upon which a paintball is configured to rest.*

*31. The rapid feed paintball loader of claim 28, further comprising a detector in communication with the motor, the detector positioned to detect a presence of paintballs in the exit tube, the motor rotating the drive cone in response to the detector detecting that paintballs are not present at a selected position within the exit tube.*

*32. The rapid feed paintball loader of claim 28, further comprising a detector in communication with the motor, the detector positioned to detect paintballs at a selected position in the exit tube, wherein the motor is configured to operate until the presence of a paintball is detected by the detector at a selected position within the exit tube.*

*33. The rapid feed paintball loader of claim 28, further comprising a detector in communication with the motor, the detector positioned to detect a presence of paintballs in the exit tube, the motor rotating the drive cone in response to the detector signaling for the demand of paintballs in the exit tube.*

* * * * *